US005804745A

United States Patent [19]

Higasa

[11] Patent Number: 5,804,745

[45] Date of Patent: Sep. 8, 1998

[54] APPARATUS FOR ADJUSTING SOUND VOLUME OF GRAND PIANO

[75] Inventor: Hirotaka Higasa, Shizuoka-ken, Japan

[73] Assignee: Kabushiki Kaisha Kawai Gakki Seisakusho, Hamamatsu, Japan

[21] Appl. No.: 592,295

[22] PCT Filed: Jul. 19, 1995

[86] PCT No.: PCT/JP95/01436

§ 371 Date: Feb. 8, 1996

§ 102(e) Date: Feb. 8, 1996

[87] PCT Pub. No.: WO96/03739

PCT Pub. Date: Feb. 8, 1996

[30] Foreign Application Priority Data

Jul. 26, 1994 [JP] Japan ..... 6-174203

[51] Int. Cl.[6] ..... G10C 3/02

[52] U.S. Cl. ..... 84/182; 84/216

[58] Field of Search ..... 84/182, 216

[56] References Cited

U.S. PATENT DOCUMENTS 1,722,978 7/1929 Hammond, Jr. ..... 84/182

FOREIGN PATENT DOCUMENTS 62-184593 11/1962 Japan .
45-24290 9/1970 Japan .
52-48825 4/1977 Japan .
56-110481 8/1981 Japan .
3-52793 5/1991 Japan .

*Primary Examiner*—Renee S. Luebke
*Assistant Examiner*—Shih-yung Hsieh
*Attorney, Agent, or Firm*—Armstrong, Westerman, Hattori, McLeland & Naughton

[57] ABSTRACT

The present invention relates to an apparatus for adjusting a sound volume of a grand piano.

When a grand piano is played, it is desired to adjust its sound volume depending on the surrounding conditions such as in an apartment house, or at night or the like.

The present invention has an object of obtaining an apparatus for adjusting the sound volume of a grand piano in which an adjustment can be made to a desired sound volume by a simple operation and which has a sufficient sound-insulating effect. It is characterized in that a lower opening portion of a case is covered by a sound-insulating board which has an opening and closing portion. Further, it is characterized in that, in a grand piano which is provided with a music rack which can be erected and laid down inside the case in the front portion of a top board, there is provided a sound-insulating board in close contact with an inner wall of the case between a plate along which the strings are extended and the music rack, and that the sound-insulating board is provided, in a manner that can be erected and laid down, with a sound-insulating opening and closing board which opens and closes an opening portion between the sound-insulating board and a front edge of the rear portion of the top board.

3 Claims, 7 Drawing Sheets

FIG. 1
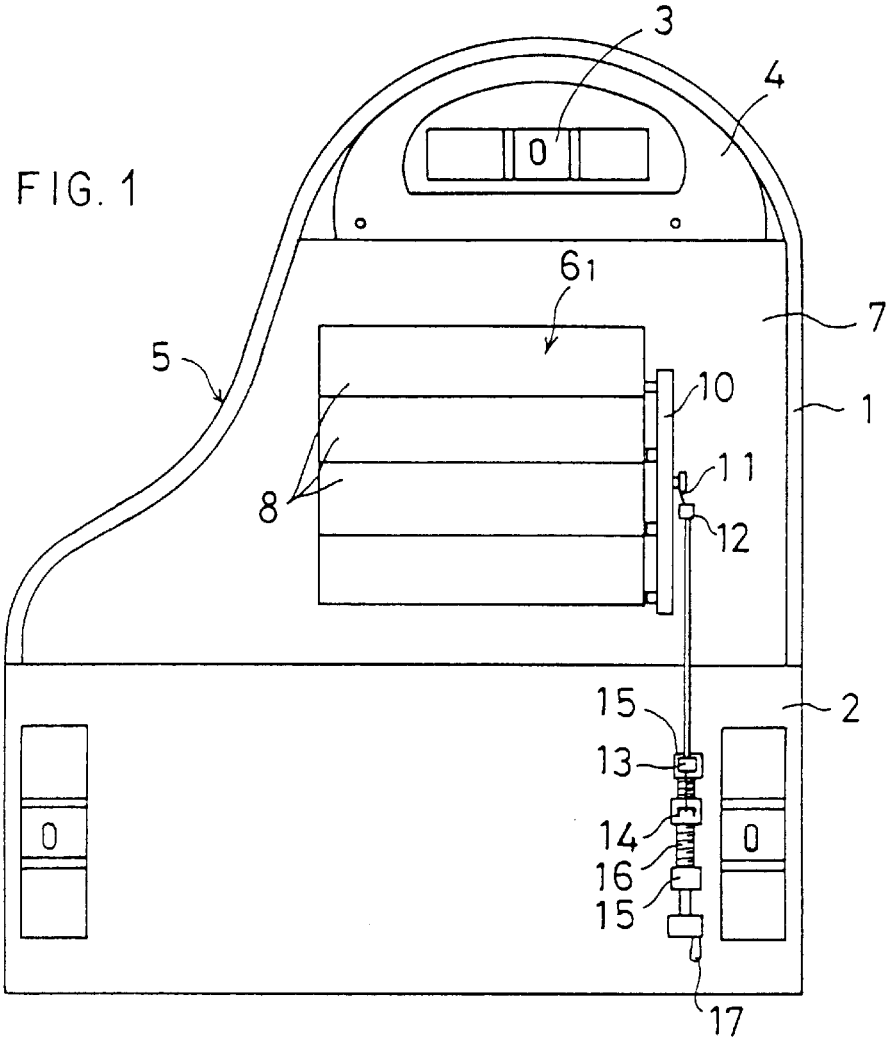
FIG. 2(A)
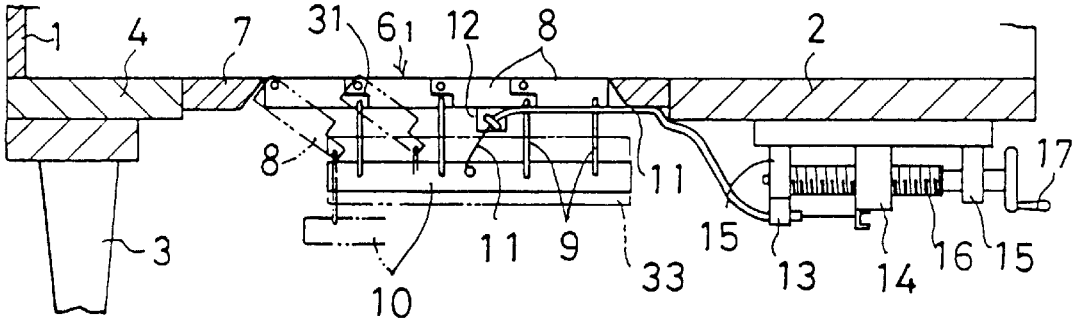
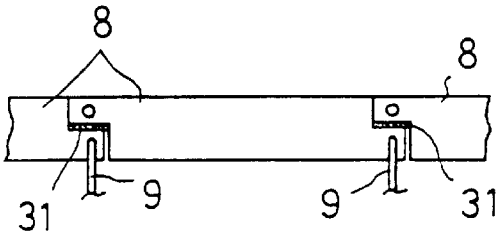
FIG. 2(B)

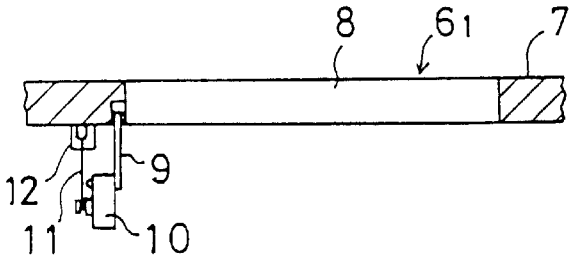
FIG. 3
FIG. 4
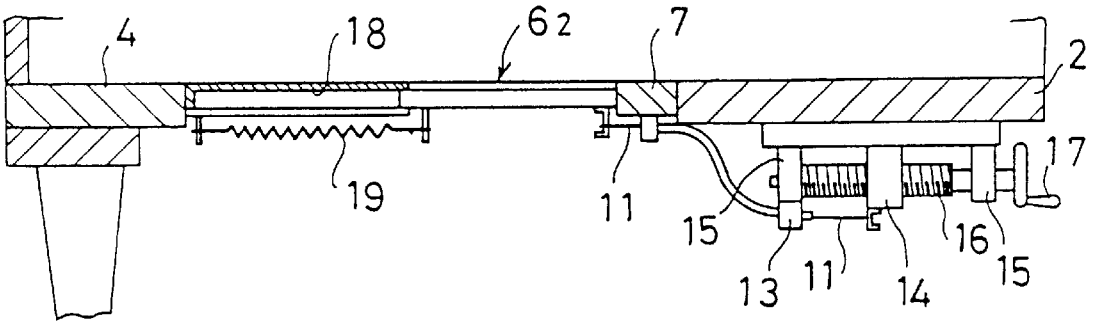
FIG. 5
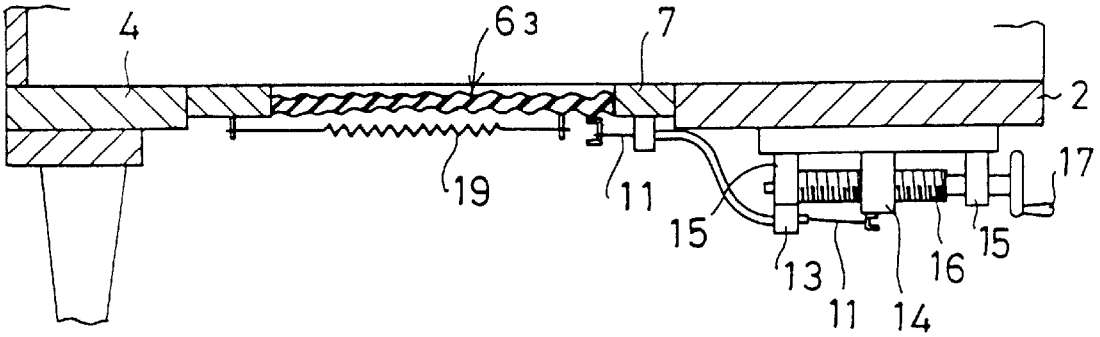

FIG. 8
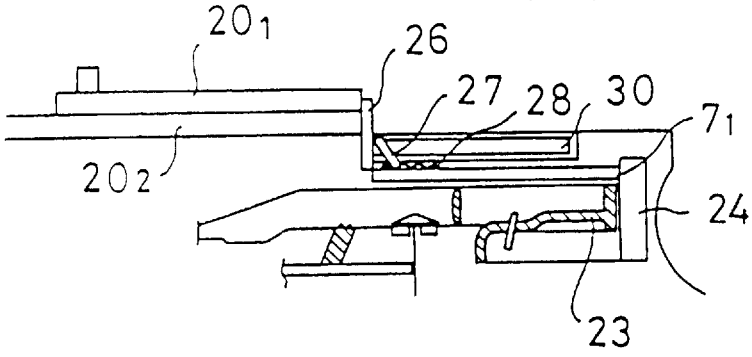
FIG. 9(A)
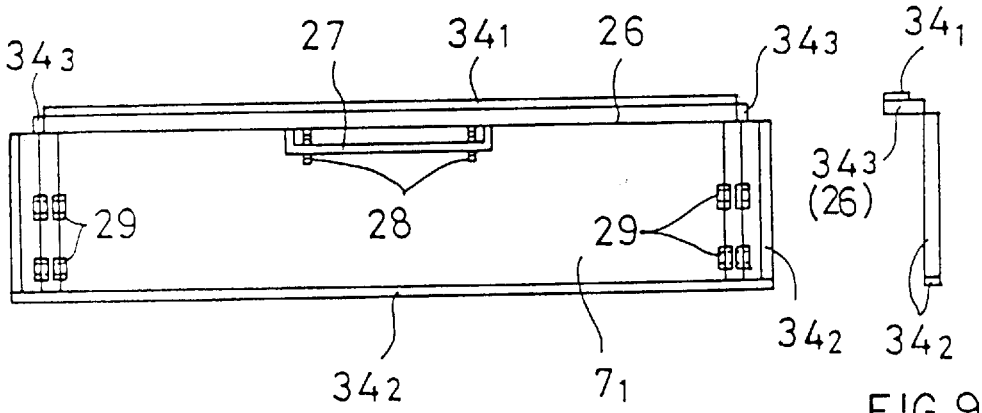
FIG. 9(B)
FIG. 10(A)
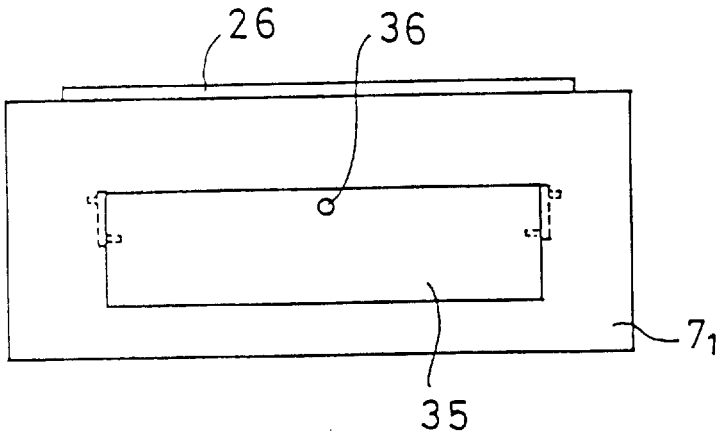
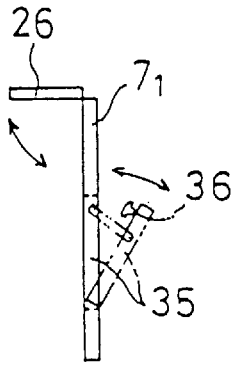
FIG. 10(B)

APPARATUS FOR ADJUSTING SOUND VOLUME OF GRAND PIANO

TECHNICAL FIELD

The present invention relates to an apparatus for adjusting a sound volume of a grand piano.

1. Background Art

When a grand piano is played, it is desirable to adjust its sound volume depending on the surrounding conditions such as in an apartment house, at night or the like. However, the actual state of things is that there cannot be found a grand piano which can be adjusted to a desired sound volume with a simple operation and which has a sufficient sound-insulating effect.

2. Disclosure of the Invention

The present invention has an object of solving this kind of problems.

In order to attain the above objects, the apparatus for adjusting a sound volume of a grand piano relating to the present invention, as described in claim 1, is characterized in that a lower opening in a case of the grand piano is covered by a sound-insulating board having an opening and closing portion. The opening and closing portion is made up of a louver, a door, or a bellow which can be opened and closed, and is arranged to be opened and closed by an operating member which is provided on a lower portion of the case. The operating member has a construction which is made up of a wire which is connected to an opening and closing member of the opening and closing portion, a travelling block which is connected to the wire and which is movable in a direction of extending the wire, and a rotatable threaded bar with which the travelling block is engaged in a threaded manner and to one end of which is attached a handle or a construction, as described in claim 6, which is made up of a wire which is connected to the louver, a first lever to one end of which the wire is connected and in which a spring is extended between said one end and a lower portion of the case, and a second lever a front end of which is pivotally supported in a rotatable manner by a supporting member which is provided on a lower portion of the case and in which the other end of the first lever is pivotally attached in a rotatable manner to an intermediate portion of the second lever, wherein the spring is fixed at one end thereof to a lower portion of the case such that, when the first lever and the wire connected thereto move in response to the rotation of the second lever whereby the louver moves from a closing direction to an opening direction, a spring force to tract the wire in a direction of moving the louver from the opening direction to the closing direction is generated. Another apparatus for adjusting the sound volume according to the present invention is, as described in claim 7, characterized in that, in a grand piano in which that top board of a case which can be opened and closed is made up of a front portion and a rear portion which are connected together by hinges and in which a music rack which can be erected and laid down is mounted on an inside of the case on the front portion side, a sound-insulating board is provided between that plate for extending strings therealong which is mounted inside the case and the music rack in close contact with an inner wall of the case, and that a sound-insulating opening and closing board is provided, in a manner that can be erected and laid down, on the sound-insulating board, the sound-insulating opening and closing board being operated to open and close an opening portion between the sound-insulating board and a front edge of the rear portion of the top board. In the apparatus as described in claim 7, it may be arranged, as described in claim 8, that the lower opening of the case is covered by a sound-insulating board having an opening and closing portion. The sound-insulating board that is provided, in the apparatus as described in claim 7, between the plate along which the strings are extended and the music rack may be provided with an opening and closing portion. Further, an air bag may be disposed between the sound-insulating board in the lower opening of the case and a sound board, the air bag being capable of inflating by charging air thereinto for urgingly contacting the sound board to thereby restrain vibration of the sound board and being capable of taking out through the opening and closing portion by discharging air therefrom.

According to the apparatus as described in claim 1, when the grand piano is played in a condition in which the top board and the opening and closing portion of the sound-insulating board are closed, the sounds that are generated by the strings are not leaked outside from the upper portion and the lower portion of the case. Therefore, the sound volume becomes remarkably small. When the above-described opening and closing portion is opened, the sound volume is adjusted depending on the degree of opening thereof. Since the opening and closing portion is opened and closed by the operating member which is provided on a lower portion of the case, an adjustment can be made to a desired sound volume by a simple operation. According to the operating member as described in claim 6, even if the operator leaves his or her hands off the second lever in the course of opening the louver, the louver will not suddenly open due to its weight but can be opened slowly by the rotation of the second lever. According to the apparatus as described in claim 7, in case the front portion of the top board is opened and the music rack mounted inside is erected in order to play the grand piano while looking at the music paper, if the sound-insulating opening and closing board of the sound-insulating board is erected to thereby close the opening portion between the front edge of the rear portion of the top board and the sound-insulating board, the sound will not leak from the upper portion of the case and therefore the sound volume becomes small. If this sound-insulating opening and closing board is opened, the sound volume can be adjusted depending on its opening degree. According to the apparatus as described in claim 8, even when the grand piano is played by looking at the music paper with the music rack erected, if a condition is attained in which the above-described opening portion is closed by erecting the sound-insulating opening and closing board and in which the opening and closing portion of the sound-insulating board in the lower opening portion of the case is closed, the sound volume becomes remarkably small. If a condition is attained in which the opening portion is opened by laying down the above-described sound-insulating opening and closing board and in which the opening and closing portion of the above-described sound-insulating board is left open, the sound volume becomes maximum in a condition in which the rear portion of the top board is closed. If an opening and closing portion is provided, as described in claim 9, in the sound-insulating board between the plate along which the strings are extended and the music rack, the adjustment of the sound volume is more remarkable. If an air bag is provided between the sound-insulating board in the lower opening portion of the case and the sound board, and if the vibration of the sound board is restrained by urging the air bag against the sound board, the sound volume becomes smallest in a condition in which the top board is closed or the front portion of the top board is opened, and the sound-insulating opening and closing board of the sound-insulating board is erected and in which the opening and closing portion of the sound-insulating board in the lower opening portion of the case is closed.

BRIEF DESCRIPTION OF THE DRAWINGS

FIG. 1 is a general bottom view of one example of the apparatus for adjusting a sound volume of a grand piano relating to the present invention.

FIGS. 2(A) and (B) are a cross-sectional view of an important portion of the apparatus shown in FIG. 1 and an enlarged partial side view thereof.

FIG. 3 is a cross-sectional front view of an important portion of the apparatus shown in FIG. 1.

FIG. 4 is a cross-sectional side view of another example of an opening and closing portion of the apparatus shown in FIG. 1.

FIG. 5 is a cross-sectional side view of still another example of an opening and closing portion of the apparatus shown in FIG. 1.

FIG. 8 is a cross-sectional side view of an important portion of the apparatus in FIG. 6 in a condition in which the front portion of the top board is opened and the sound-insulating opening and closing board is erected.

FIGS. 9(A) and (B) are a plan view and a side view, respectively, of the sound-insulating board shown in FIG. 7.

FIGS. 10(A) and (B) are a plan view and a side view, respectively, of a modified example of the sound-insulating board shown in FIG. 7.

BEST MODE FOR CARRYING OUT THE INVENTION

Figure 6:
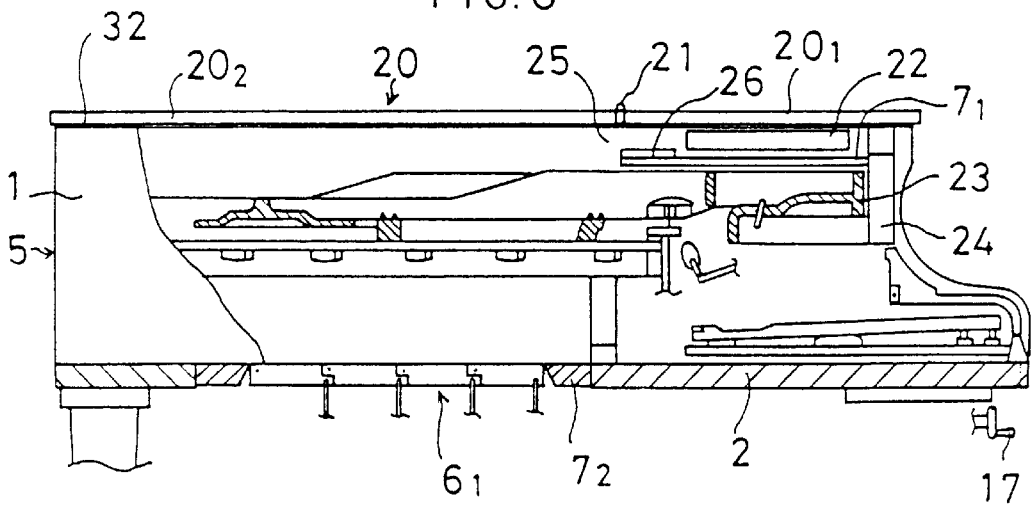
FIG. 6 is a side view, partly shown in section, of another example of the apparatus for adjusting a sound volume of a grand piano relating to the present invention.

An explanation will hereinafter be made about an apparatus for adjusting a sound volume of a grand piano ,relating to the present invention with reference to the accompanying drawings.

FIG. 1 through FIG. 3 show an example of the apparatus for adjusting a sound volume of a grand piano.

In the Figures, reference numeral 1 denotes an outer rim which encloses therein a plate for extending strings therealong, a keyboard, a sound board (see FIG. 6) or the like. An opening portion in the front portion of the outer rim is closed by an upper beam and a fall board (see FIG. 6), and a top board is mounted on an upper end of the outer rim in a manner to be capable of opening and closing towards one side thereof. In the lower end, there is formed a key bed 2 in its front portion, and there is formed, in its rear portion, a leg block 4 for attaching thereto a leg 3, thereby forming a case 5. The portion between the key bed 2 and the leg block 4 is left open. This construction is not particularly different from the conventional one.

According to the present invention, in this lower opening portion in the case 5, there is provided a sound-insulating board 7 having an opening and closing portion $\mathbf{6}_1$. This sound-insulating board 7 is made of a sound-insulating material such as a particle board, a hardboard or the like or of a sound-absorbing material such as glass wool, felt or the like. The opening and closing portion $\mathbf{6}_1$, in this example, is made up of a louver which can be opened and closed. This louver is arranged by a plurality of louver boards 8 each of which is connected to a horizontal member 10 via a rod whose one end is rotatably connected to the respective louver boards 8, and is opened and closed by an operating member. The operating member is made up of a wire 11, a travelling block 14 and a rotatable threaded bar 16 which is provided on one end thereof with a handle 17. To the above-described horizontal member 10 there is fixed one end of the wire 11. This wire 11 is supported by wire holders 12, 13 and the other end thereof is fixed to the travelling block 14. This travelling block 14 is screwed onto the threaded bar 16 which is supported by bearings 15. By rotating the handle 17 which is fixed to one end of the threaded bar 16, the travelling block 14 moves forwards and backwards. By a vertical movement of the horizontal member 10 as a result of the travelling movement of the wire 11, the louver boards 8 are rotated to thereby open and close the louver. In order to prevent as much as possible the sound from leaking through this opening and closing portion $\mathbf{6}_1$ when the louver is closed, there are adhered rubber packings 31 for pressingly contacting the louver boards 8 which lie close to the end portions which are opposite to the rotatably supported ends of the louver boards 8. On an upper end surface of the outer rim 1, there is attached a rubber packing 32 of a height of 5 mm, for example, in place of conventional rubber buttons. By this arrangement, when the top board is closed, there can be prevented such a leaking of the sound through the clearance between the top board and the outer rim 1 as was the case with rubber buttons. In FIG. 2, reference numeral 33 denotes a shielding plate which is made of a synthetic resin or the like and which is mounted to the horizontal member 10 by utilizing connecting screws for connection between the horizontal member 10 and the rods 9, for example, in order to prevent the fingers or the like from entering the space between the rods.

According to this example, when the grand piano is played in a condition in which the top board is closed and the opening and closing portion $\mathbf{6}_1$ is closed by the operation of the handle 17, the sounds to be generated from the strings are enclosed within the case 5. Therefore, the sound volume of the sounds to be emitted out of the case 5 is remarkably reduced. In case the sound may be emitted in a large volume depending on the environmental circumstances, the louver boards 8 are rotated as shown by broken lines in FIG. 2 to thereby open the opening and closing portion $\mathbf{6}_1$. Depending on the degree of this opening, the sound volume can be adjusted. If the top board is opened and the opening and closing portion $\mathbf{6}_1$ is opened to the maximum extent, the sound volume becomes maximum.

Instead of the louver of the above-described opening and closing portion $\mathbf{6}_1$, the opening and closing portion of the sound-insulating board 7 can be constructed by opening and closing portions $\mathbf{6}_2$, $\mathbf{6}_3$ as shown in FIG. 4 and FIG. 5.

As shown in FIG. 4, the opening and closing portion $\mathbf{6}_2$ is made up of a door which can be opened and closed. The door can be pulled into, and taken out of, a recessed portion 18 which is formed in the sound-insulating board 7. The opening and closing of this door is made, like in the above-described example, by means of the wire 11 through the operation of the handle 17. The door is opened by a spring force, of a spring 19 which urges in the direction of opening.

As shown in FIG. 5, the opening and closing portion $\mathbf{6}_3$ is made up of a bellow which can be expanded and contracted, and is urged by the spring 19 in the direction of opening it. On an inner side of this bellow, there is attached a sound-insulating sheet and a sound-absorbing material.

Figure 7:
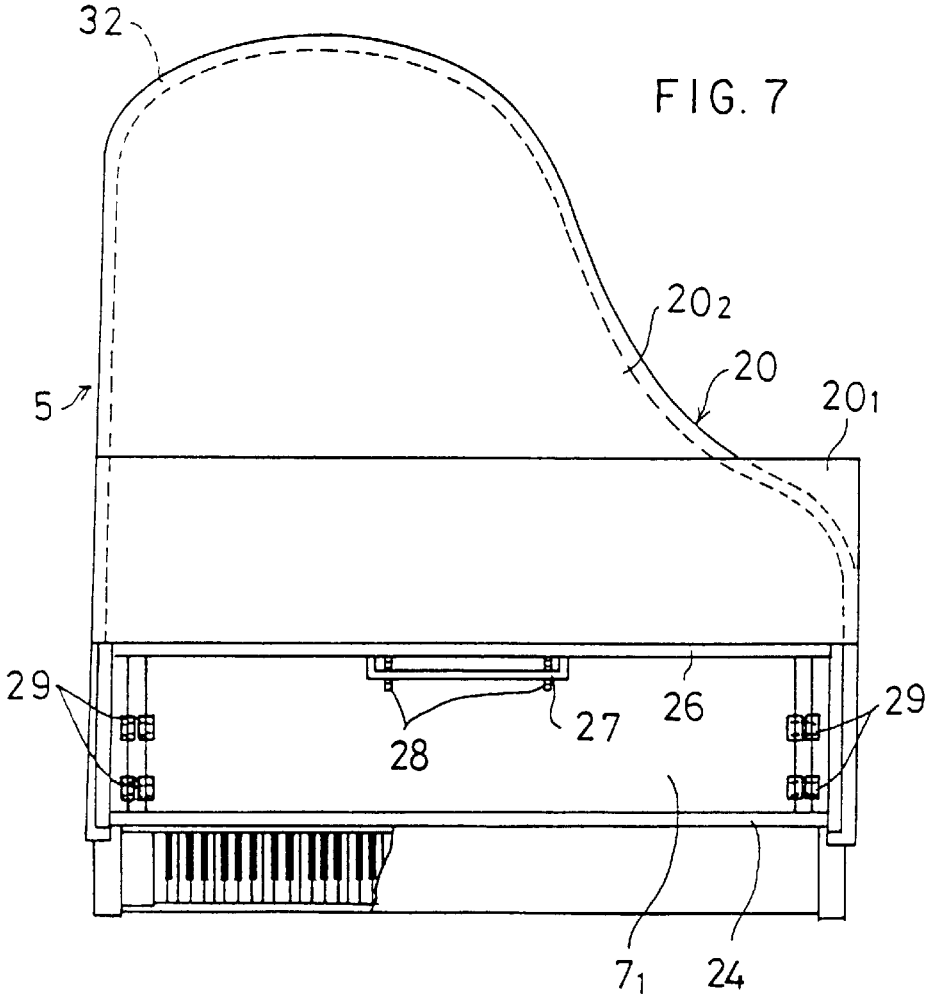
FIG. 7 is a plan view of the apparatus in FIG. 6 showing a condition in which the front portion of a top board is opened and a sound-insulating opening and closing board is erected.

FIG. 6 through FIG. 8 show another example of the apparatus for adjusting a sound volume of a grand piano.

In the Figures, a top board 20 is made up of a front portion $\mathbf{20}_1$ and a rear portion $\mathbf{20}_2$ which is connected to the front portion by means of hinges 21. The top board is connected to the outer rim 1 on the left side in FIG. 7 by means of hinges (not illustrated) and can be opened and closed to cover an upper opening portion in the outer rim 1. On an upper end surface of the outer rim 1 there is mounted the rubber packing 32 of a height of 5 mm, for example, as described hereinbefore. By this construction, it is so arranged that, when the top board 20 is closed, the sound leaking through the clearance of about 5 mm between the top board 20 and the outer rim 1 does not occur. Inside the case 5 on the side of the front portion $\mathbf{20}_1$ of the top board 20, there is contained a music rack assembly 22 (FIG. 6). When the music rack is used, after the front portion $\mathbf{20}_1$ is folded towards the rear portion $\mathbf{20}_2$, the music rack is erected. This arrangement is not different from the conventional one.

In the present invention, between the music rack assembly 22 and a plate 23 for extending the strings therealong, there is provided a sound-insulating board 7 in a condition in which the right and left side surfaces and the front side surface thereof are kept in close contact with the outer rim 1 and an upper beam 24, respectively. To this sound-insulating board $\mathbf{7}_1$ there is mounted a sound-insulating opening and closing board 26 which opens and closes an opening 25 which is formed between its rear end portion and a front end of the rear portion $\mathbf{20}_2$ of the top board 20 so as to be rotatable on the sound-insulating board $\mathbf{7}_1$ by hinges at the lower end thereof. It is so arranged that the opening degree of the sound-insulating opening and closing board 26 can be adjusted by engaging a member 27 (normally called a music rack prop) which is provided on the rear surface of the sound-insulating opening and closing board 26 in a rotatable manner, with a suitable position of saw-toothed projections and recessions 28 on the sound-insulating board $\mathbf{7}_1$. The sound-insulating board $\mathbf{7}_1$ and the sound-insulating opening and closing board 26 are made by respectively adhering a decorating material on one surface and a sound-insulating sheet on the opposite surface. As shown in FIG. 9, a rubber packing $\mathbf{34}_1$ is adhered to that surface of the sound-insulating board 26 which is on the side of the rear portion $\mathbf{20}_2$ of the top board 20. It is so arranged that, when the grand piano is played in a condition in which the sound-insulating opening and closing board 26 is erected so as to abut a butt end of the rear portion $\mathbf{20}_2$ of the top board 20, there can prevent the generation of noises due to the striking of the sound-insulating opening and closing board 26 against the butt end by its vibration. Further, rubber packings $\mathbf{34}_2$ and $\mathbf{34}_3$ are adhered to the front side surface and the right and left side surfaces of the sound-insulating board $\mathbf{7}_1$ as well as to the right and left side surfaces of the sound-insulating opening and closing board 26. It is thus so arranged that, even if the machining accuracy of the upper beam 24 and the outer rim 1 is somewhat poor, the packings sufficiently absorb the inaccuracy as a clearance, whereby there will not give rise to the occurrence of a clearance and the occurrence of a sound leak between the sound-insulating board $\mathbf{7}_1$ and the upper beam 24 and the outer rim 1 as well as between the sound-insulating opening and closing board 26 and right and left side boards 30. As clearly shown in FIG. 7 and FIG. 9, the sound-insulating board $\mathbf{7}_1$ is so arranged that it can be folded towards both sides at two places respectively by means of hinges 29. Therefore, if both sides of the sound-insulating board $\mathbf{7}_1$ are folded at two positions, the sound-insulating board $\mathbf{7}_1$ can be disposed between the music rack assembly 22 and the plate 23 for extending the strings therealong without removing right and left side boards 30 which are provided in the outer rim 1 to support the music rack assembly 22 (not illustrated in FIG. 8). In the lower opening portion of the case 5 there is provided a sound-insulating board $\mathbf{7}_2$ having the opening and closing member $\mathbf{6}_1$ like in the example shown in the above-described FIG. 1 through FIG. 3. Details thereof are not explained here because they are as described hereinabove. In place of the opening and closing member $\mathbf{6}_1$, the above-described opening and closing members $\mathbf{6}_2$ and $\mathbf{6}_3$ may also be used.

The operation of this apparatus will now be explained.

When the grand piano is played while looking at the music paper at night, for example, when silence is particularly required, that opening and closing portion $\mathbf{6}_1$ of the sound-insulating board $\mathbf{7}_2$ which is provided in the lower opening portion of the case 5 is closed. The sound-insulating opening and closing board 26 of the sound-insulating board $\mathbf{7}_1$ in the upper part of the case 5 is erected as shown in FIG. 8 to thereby close the opening portion 25. In this manner, the sounds to be generated from the strings are contained inside the case 5 and, therefore, the sounds to be emitted outside become remarkably reduced. When the sounds are to be somewhat increased, the opening degrees of the sound-insulating opening and closing board 26 of the upper sound-insulating board $\mathbf{7}_1$ and the lower opening and closing portion $\mathbf{6}_1$ of the case 5 are adjusted to increase or decrease the sound volume. When the sound volume need not be considered much, the sound volume can be maximized if both are opened to a maximum extent.

If the upper sound-insulating board $\mathbf{7}_1$ is further provided with an opening and closing board 35, as shown in FIG. 10, aside from the sound-insulating opening and closing board 26, as shown in FIG. 10, the adjustment of the sound volume can be remarkably made by opening and closing it with a handle 36.

When the sound emission need not constantly be reduced remarkably, the sound-insulating board $\mathbf{7}_2$ need not be provided in the lower opening portion of the case 5.

Figure 11A:
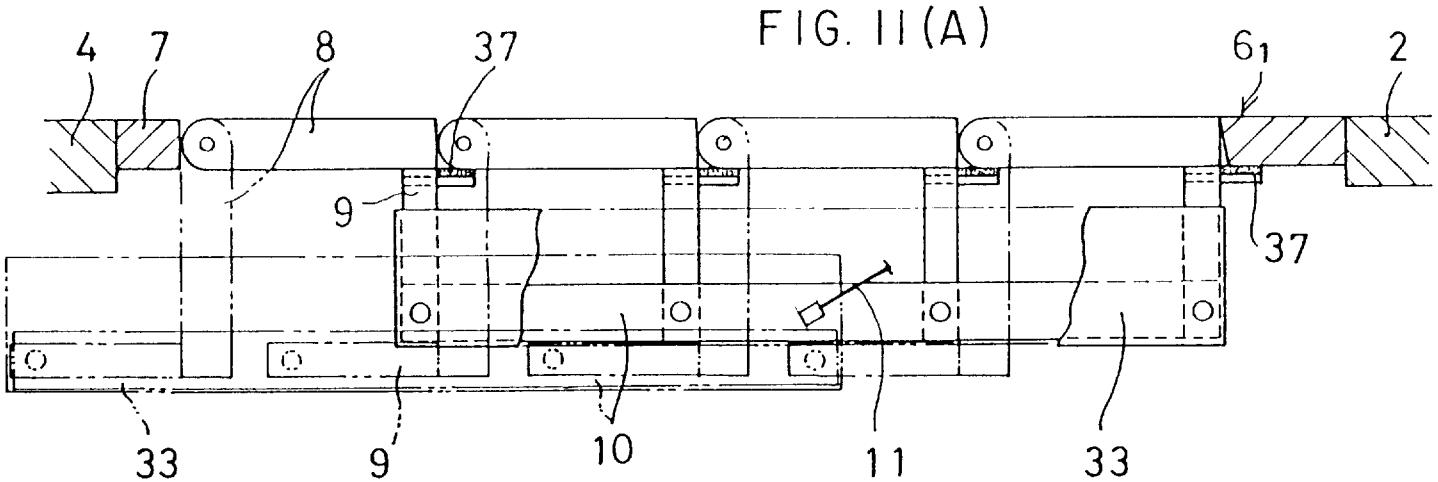
FIGS. 11(A) and (B) are a side view and a front view, respectively, of a modified example of the opening and closing portion shown in FIG. 2.
Figure 11B:
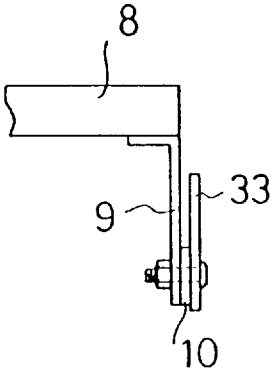

FIG. 11 shows a modified embodiment of the opening and closing portion $\mathbf{6}_1$. The rods 9 are fixedly adhered to the louver boards 8 and the horizontal member 10 is rotatably connected to the rods 9. Reference numeral 33 denotes a shielding plate comprising a synthetic resin board or the like which is fixed to the horizontal member 10 by utilizing connecting screws for connecting the horizontal member 10 and the rods 9 so that the fingers or the like cannot be inserted between the rods, as described above. Reference numeral 37 denotes rubber packings which are mounted on front ends of the respective louver boards 8 via supporting plates in order to prevent the sound from leaking.

Figures 12A, 12B:
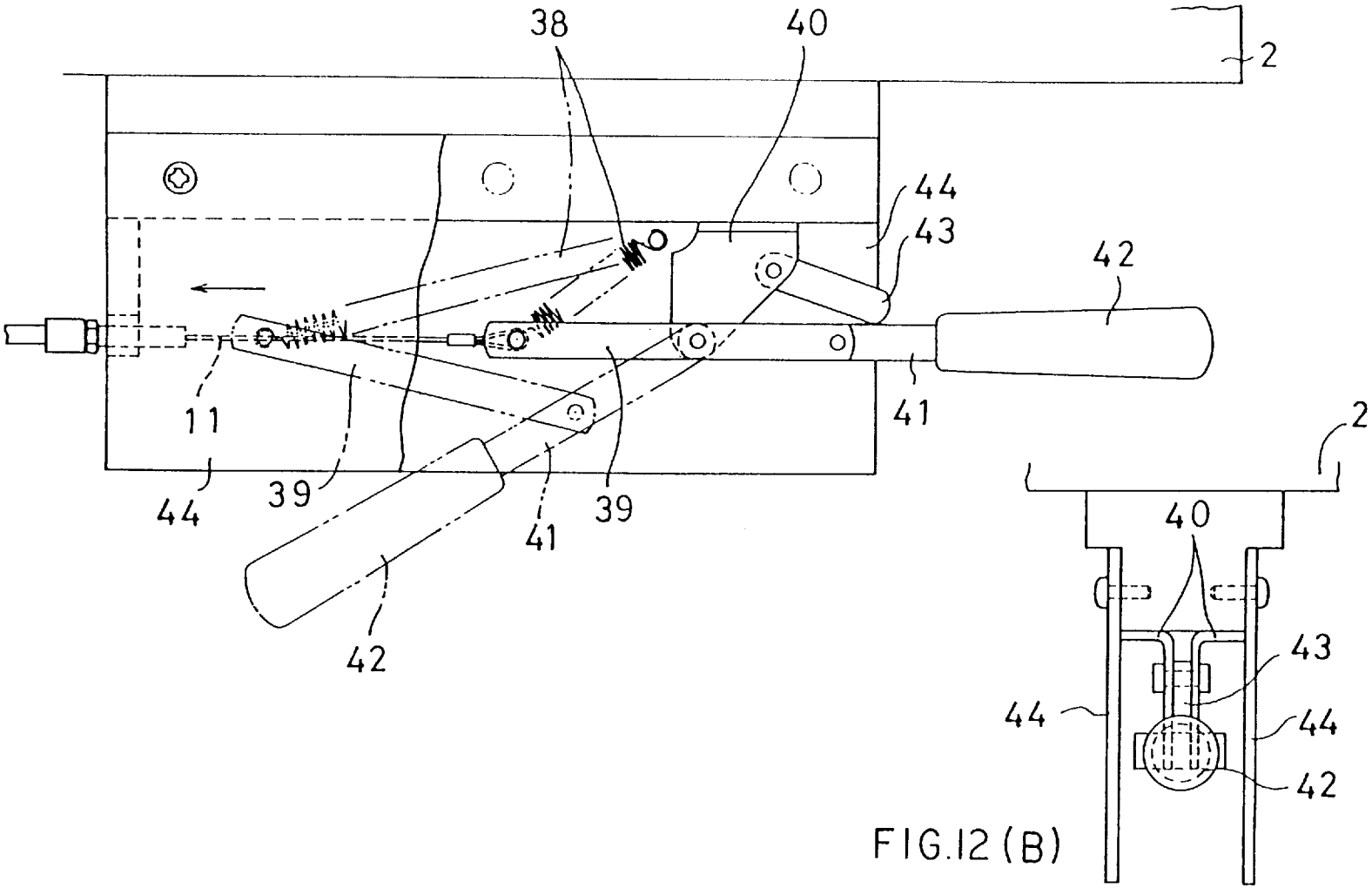
FIGS. 12(A) and (B) are a side view and a front view, respectively, of a modified example of the operating apparatus shown in FIG. 2, FIG. 4 and FIG. 5.

FIG. 12 shows another example of the operating member.

This operating member comprises a wire 11, a first lever 39 to one end of which the wire 11 is connected and in which a spring 38 is extended between the above-described one end and a lower portion of the key bed 2, and a second lever 41 whose front end is rotatably supported by a supporting member 40 which is provided on a lower portion of the key bed 2 and in which the other end of the first lever 39 is rotatably supported by an intermediate portion of the second lever. The above-described spring 38 is attached at its one end to the key bed 2 after due positioning such that, when the above-described second lever 41 is rotated by the handle 42 at its front end to thereby move the above-described louver from the closing direction to the open direction by the movement, towards an illustrated arrow, of the wire 11 connected to the first lever 39, a spring force to tract the wire 11 in the direction of closing the louver is generated. Reference numeral 43 denotes a stopper for stopping the second lever 41 in a desired position.

According to this operating member, the louver can be changed from the open position to the closed position or from the closed position to the open position relatively quickly. Further, when the second lever 41 is rotated to rotate the louver from the closed position to the open position, even if the hands are off therefrom in the course of the operation, the louver can be gently opened because, even if the louver tries to open by its own weight, the spring force in the direction of closing position is being operated on the louver by means of the spring 38. When the louver is to be closed, the second lever 41 is rotated by the handle 42 until it abuts the stopper 43.

Reference numeral 44 denotes shielding members for shielding to prevent the fingers or the like from being inadvertently placed between each of the members such as the first lever 39, the second lever 41, the spring 38 or the like, and they are fixed by screws to the lower part of the key bed 2.

Figure 13:
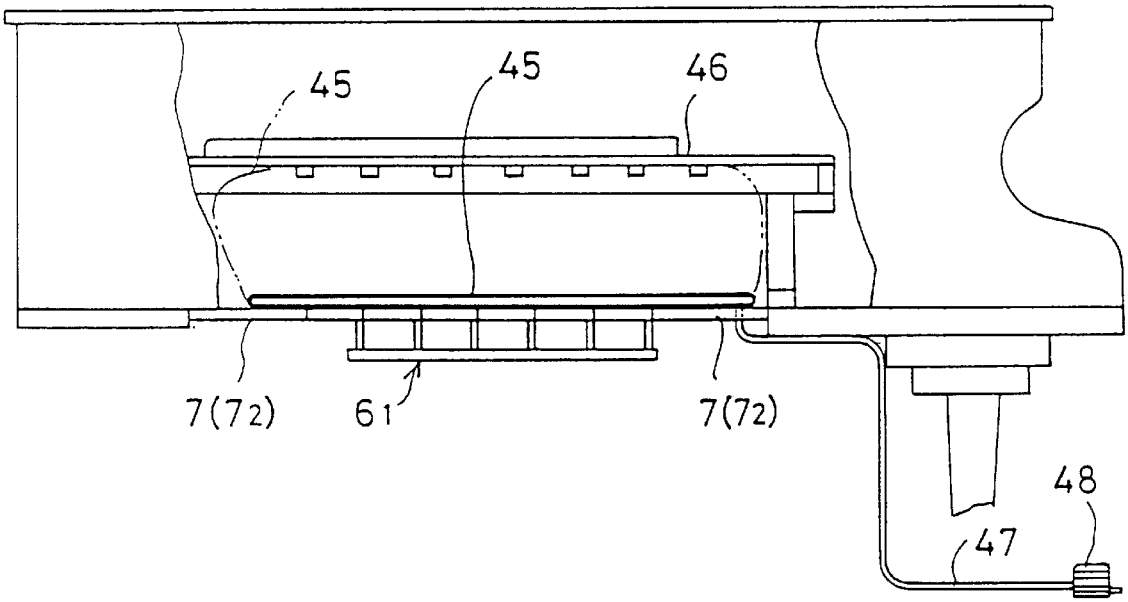
FIG. 13 is a side view, partly shown in section, of the apparatus shown in FIG. 1 and FIG. 6 in which an air bag is provided.

FIG. 13 shows a modified example of the apparatus for adjusting a sound volume as shown in FIG. 1 and FIG. 6.

In the Figure, an air bag 45 is provided in a space between the sound-insulating board 7 ($\mathbf{7}_2$) and a sound board 46. This air bag 45 is arranged to be mounted to, or dismounted from, the fully opened opening and closing portion $\mathbf{6}_1$ (opening and closing portion $\mathbf{6}_2$ or $\mathbf{6}_3$ will also do). It is connected to a foot pump 48 via a tube 47.

When the sound volume is to be further reduced in a condition in which the opening and closing member $\mathbf{6}_1$ is closed, the air is sent by the foot pump 48 to inflate the air bag 45 so as to pressingly contact the air bag 45 with the sound board 46, thereby restraining the vibration of the sound board 46.

I claim:

1. An apparatus for adjusting a sound volume of a grand piano having a case with a lower opening, the apparatus comprising:

a sound-insulating board, having an opening and closing portion, for covering the lower opening of the case; and an operating member which is operably coupled to the sound-insulating member, wherein the operating member is comprised of a wire which is connected to an opening and closing member of the opening and closing portion, a travelling block which is connected to the wire and which is movable in a direction of extending the wire, and a rotatable threaded bar with which the travelling block is engaged in a threaded manner and to one end of which is attached a handle.

2. The apparatus for adjusting a sound volume of a grand piano according to claim 1, wherein said opening and closing portion is made up of a louver which can be opened and closed and wherein said louver is arranged to be opened and closed by an operating member disposed on a lower portion of the case.

3. An apparatus for adjusting a sound volume of a grand piano according to claim 2, wherein said operating member is made up of a wire which is connected to said louver, a first lever to one end of which said wire is connected and in which a spring is extended between said one end and a lower portion of said case, and a second lever a front end of which is pivotally supported in a rotatable manner by a supporting member which is provided on a lower portion of said case and in which the other end of said first lever is pivotally attached in a rotatable manner to an intermediate portion of said second lever, wherein said spring is fixed at one end thereof to a lower portion of said case such that, when said first lever and said wire connected thereto move in response to the rotation of said second lever whereby said louver moves from a closing direction to an opening direction, a spring force to tract said wire in a direction of moving said louver from the opening direction to the closing direction is generated.

* * * * *